US009685046B2

(12) United States Patent
Walker

(10) Patent No.: US 9,685,046 B2
(45) **Date of Patent: *Jun. 20, 2017**

(54) GAMING MACHINE WITH BUY FEATURE GAMES

(75) Inventor: Peter Leslie Walker, Marsfield (AU)

(73) Assignee: Aristocrat Technologies Australia Pty Limited (AU)

( * ) Notice: Subject to any disclaimer, the term of this patent is extended or adjusted under 35 U.S.C. 154(b) by 366 days.

This patent is subject to a terminal disclaimer.

(21) Appl. No.: 13/362,035

(22) Filed: Jan. 31, 2012

(65) Prior Publication Data

US 2012/0202586 A1 Aug. 9, 2012

(30) Foreign Application Priority Data

Feb. 3, 2011 (AU) ..... 2011200453

(51) Int. Cl.
*G07F 17/32* (2006.01)
*G07F 17/34* (2006.01)

(52) U.S. Cl.
CPC ..... *G07F 17/34* (2013.01); *G07F 17/3244* (2013.01); *G07F 17/3255* (2013.01); *G07F 17/3267* (2013.01)

(58) Field of Classification Search
CPC ..... G07F 17/3244; G07F 17/3255
USPC ..... 463/25
See application file for complete search history.

(56) References Cited

U.S. PATENT DOCUMENTS

2005/0085295 A1* 4/2005 Walker ..... G07F 17/32 463/25
2006/0035701 A1* 2/2006 Walker ..... G07F 17/3244 463/20
2008/0182650 A1* 7/2008 Randall et al. ..... 463/25
2009/0117961 A1* 5/2009 Bennett et al. ..... 463/16
2010/0075746 A1* 3/2010 Anderson ..... G07F 17/323 463/25

* cited by examiner

*Primary Examiner* — Steven J Hylinski
(74) *Attorney, Agent, or Firm* — McAndrews, Held & Malloy, Ltd.

(57) ABSTRACT

A gaming system comprising an input device for placing wagers. The wagers include a first wager consisting of a base wager, and second and third wagers, each consisting of a base wager portion and an additional wager portion. The third wager has a higher ratio of the additional wager portion to the base wager portion than the second wager. An outcome is based on the first, second or third wager, such that upon said second wager being made and an designated event associated with the second wager occurring, a first additional benefit relative to when the first wager is made is provided, and upon said third wager being made and a designated event associated with the third wager occurring, a second additional benefit relative to when the first wager is made is provided. The second additional benefit is a greater benefit than the first additional benefit.

15 Claims, 5 Drawing Sheets

GAMING MACHINE WITH BUY FEATURE GAMES

RELATED APPLICATIONS

This application claims priority to Australian Provisional Patent Application Number 2011200453, having an International filing date of Feb. 3, 2011, which is incorporated herein by reference.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to a gaming machine, a method of gaming, a gaming system and a game controller.

Players regularly playing gaming machines need to have their interests maintained. Therefore, it is necessary for manufacturers of these machines to develop inventive game features which add interest to the games provided on such machines in order to keep the players entertained and willing to continue to play the games.

There is a continuous trade-off between what the players of the machines want and what the operators of the machines want from the machines. Naturally, operators want the players to stake more money per game so that the overall turnover is higher. Conversely, players will not do this unless they feel that they are getting more for the extra money that they are betting.

Further, as the range of machines and games increases, it is becoming increasingly important to offer more options to the players. The more options that are available in one machine, the easier it is to maintain the player's interest and the easier it is for players to be able to gain access to a machine that will offer them exactly the game that they want.

To date, most types of video gaming machines which are available to players offer limited options. At best, a range of bet sizes and paylines upon which the players can bet are offered. Certain machines also offer a double-up option available after a win while other machines have various ranges of paytables particularly for higher bets.

BRIEF SUMMARY OF THE INVENTION

In a first aspect, the invention provides a gaming system comprising:

at least one input device operable by a player to place one of a plurality of possible wagers on a play of the game and initiate the play of the game, the plurality of possible wagers comprising a first wager consisting of a base wager, and second and third wagers each consisting of a base wager portion and an additional wager portion, the third wager having a higher ratio of the additional wager portion to the base wager portion than the second wager;

a game controller arranged to control operation of the gaming system and responsive to the at least one input device to implement the play of the game by generating at least one game outcome based on game play rules stored in a memory and evaluating the game outcome to determine whether the player is entitled to one or more awards based on the at least one game outcome;

a display that displays each game outcome under the control of the game controller, the display of each game outcome including displaying a plurality of symbols at a plurality of display positions on the display, the game controller arranged to control which of the game play rules are used to generate the at least one game outcome in the play of the game based at least on whether the wager in respect of the play of the game is the first, second or third wager, such that upon said second wager being made and at least one designated event associated with the second wager occurring in the play of the game, the game controller provides a first additional benefit to the player relative to when the first wager is made, and upon said third wager being made and at least one designated event associated with the third wager occurring in the play of the game, the game controller provides a second additional benefit to the player relative to when the first wager is made, the second additional benefit being a greater benefit than the first additional benefit.

In an embodiment, a common designated event is associated with both the second and third wagers.

In an embodiment, the common designated event is a trigger event which triggers the game controller to generate at least one additional game outcome.

In an embodiment, the game controller generates a single game outcome in a game in which the trigger event does not occur.

In an embodiment, the game controller generates a plurality of additional game outcomes in response to the trigger event and provides a greater benefit for the third wager by generating more additional game outcomes when the trigger event occurs in respect of the third wager than in respect of the second wager.

In an embodiment, the game controller also generates a plurality of additional game outcomes upon the trigger event occurring in respect of the first wager and the first and second additional benefits comprise different numbers of additional game outcomes.

In an embodiment, the game is a spinning reel game in which the game controller generates a game outcome by controlling the reels to be displayed as spinning on the display and determining which symbols of a plurality of reels will be displayed to a player in the plurality of display positions on the display when the reels stop, and evaluates the displayed symbols to determine whether the player is entitled to an award.

In an embodiment, each additional game outcome comprises re-spinning each of the reels to determine a further set of symbols of the plurality of reels to be displayed and evaluating the further set of symbols to determine whether the player is entitled to an award.

In an embodiment, each additional game outcome comprises re-spinning a subset of the reels to determine a further set of symbols to be displayed and evaluating the further set of symbols to determine whether the player is entitled to an award.

In an embodiment, the at least one input device comprises a plurality of buttons each associated with a different one of the plurality of possible wagers such that the player places the wager with a single one of the buttons.

In an embodiment, the at least one input device is a touch screen displaying a plurality of virtual buttons.

In an embodiment, the buttons are electromechanical buttons.

In a second aspect, the invention provides a game controller for a gaming system, the game controller arranged to control operation of the gaming system and responsive initiation of a play of the game to implement the play of the game by generating at least one game outcome based on game play rules stored in a memory and evaluating the game outcome to determine whether a player is entitled to one or more awards based on the at least one game outcome and to control a display to display each game outcome by displaying a plurality of symbols at a plurality of display positions on the display, the game controller arranged to control which of the game play rules are used to generate the at least one game outcome in the play of the game based at least on whether a wager in respect of the play of the game is a first, second or third wager, the first wager consisting of a base wager, and the second and third wagers each consisting of a base wager portion and an additional wager portion, the third wager having a higher ratio of the additional wager portion to the base wager portion than the second wager such that upon said second wager being made and at least one designated event associated with the second wager occurring in the play of the game, the game controller provides a first additional benefit to the player relative to when the first wager is made, and upon said third wager being made and at least one designated event associated with the third wager occurring in the play of the game, the game controller provides a second additional benefit to the player relative to when the first wager is made, the second additional benefit being a greater benefit than the first additional benefit.

In an embodiment, a common designated event is associated with both the second and third wagers.

In an embodiment, the common designated event is a trigger event which triggers the game controller to generate at least one additional game outcome.

In an embodiment, the game controller generates a single game outcome in a game in which the trigger event does not occur.

In an embodiment, the game controller generates a plurality of additional game outcomes in response to the trigger event and provides a greater benefit for the third wager by generating more additional game outcomes when the trigger event occurs in respect of the third wager than in respect of the second wager.

In an embodiment, the game controller also generates a plurality of additional game outcomes upon the trigger event occurring in respect of the first wager and the first and second additional benefits comprise different numbers of additional game outcomes.

In an embodiment, the game is a spinning reel game in which the game controller generates a game outcome by controlling the reels to be displayed as spinning on the display and determining which symbols of a plurality of reels will be displayed to a player in the plurality of display positions on the display when the reels stop, and evaluates the displayed symbols to determine whether the player is entitled to an award.

In an embodiment, each additional game outcome comprises re-spinning each of the reels to determine a further set of symbols of the plurality of reels to be displayed and evaluating the further set of symbols to determine whether the player is entitled to an award.

In an embodiment, each additional game outcome comprises re-spinning a subset of the reels to determine a further set of symbols to be displayed and evaluating the further set of symbols to determine whether the player is entitled to an award.

In a third aspect, the invention provides a method of gaming in a gaming system comprising:

receiving one of a plurality of possible wagers on a play of the game via at least one input device and initiating the play of the game, the plurality of possible wagers comprising a first wager consisting of a base wager, and second and third wagers each consisting of a base wager portion and an additional wager portion, the third wager having a higher ratio of the additional wager portion to the base wager portion than the second wager;

controlling operation of the gaming system responsive to the at least one input device to implement the play of s the game by generating at least one game outcome based on game play rules stored in a memory and evaluating the game outcome to determine whether the player is entitled to one or more awards based on the at least one game outcome;

displaying each game outcome on a display of the gaming system, the display of each game outcome including displaying a plurality of symbols at a plurality of display positions on the display, controlling which of the game play rules are used to generate the at least one game outcome in the play of the game based at least on whether the wager in respect of the play of the game is the first, second or third wager, by upon said second wager being made and at least one designated event associated with the second wager occurring in the play of the game, providing a first additional benefit to the player relative to when the first wager is made, and upon said third wager being made and at least one designated event associated with the third wager occurring in the play of the game, providing a second additional benefit to the player relative to when the first wager is made, the second additional benefit being a greater benefit than the first additional benefit.

In an embodiment, a common designated event is associated 30 with both the second and third wagers.

In an embodiment, wherein the common designated event is a trigger event which triggers the generation of at least one additional game outcome.

In an embodiment, the method comprises generating a single game outcome in a game in which the trigger event does not occur.

In an embodiment, the method comprises generating a plurality of additional game outcomes in response to the trigger event and, wherein a greater benefit for the third wager is provided by generating more additional game outcomes when the trigger event occurs in respect of the third wager than in respect of the second wager.

In an embodiment, the method comprises generating a plurality of additional game outcomes upon the trigger event occurring in respect of the first wager and the first and second additional benefits comprise different numbers of additional game outcomes.

In an embodiment, the game is a spinning reel game and in a game outcome is generated by controlling the reels to be displayed as spinning on the display, determining which symbols of a plurality of reels will be displayed to a player in the plurality of display positions on the display when the reels stop, and evaluating the displayed symbols to determine whether the player is entitled to an award.

In an embodiment, each additional game outcome comprises re-spinning each of the reels to determine a further set of symbols of the plurality of reels to be displayed and evaluating the further set of symbols to determine whether the player is entitled to an award.

In an embodiment, each additional game outcome comprises re-spinning a subset of the reels to determine a further set of symbols to be displayed and evaluating the further set of symbols to determine whether the player is entitled to an award.

In an embodiment, each of the plurality of possible wagers are associated with respective ones of a plurality of buttons and receiving the wager comprises determining which one of the buttons has been used by the player.

In a fourth aspect, the invention provides computer program code which when executed implements the above method.

BRIEF DESCRIPTION OF SEVERAL VIEWS OF THE DRAWINGS

The invention is now described by way of example with reference to the accompanying diagrammatic drawings in which.

DETAILED DESCRIPTION OF THE INVENTION

Referring to FIGS. 1 to 6, there are shown embodiments of a gaming system 100 having a game controller 160 arranged to implement a game where certain wagers provide an additional benefit to a player when a designated event associated with the wager occurs.

Such wagers include a base wager portion and an additional wager portion. That is, the additional wager introduces eligibility to the additional benefit and the additional wager portion is a dedicated bet towards the additional benefit.

There are at least two different wagers which have additional wager portions in different ratios to the base wager portion such that at least one wager has a relatively larger additional wager portion. Advantageously, the gaming system operates such that a greater additional benefit is associated with the wager having relatively larger additional wager portion.

The gaming system 100 can take a number of different forms. In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine.

For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 1:
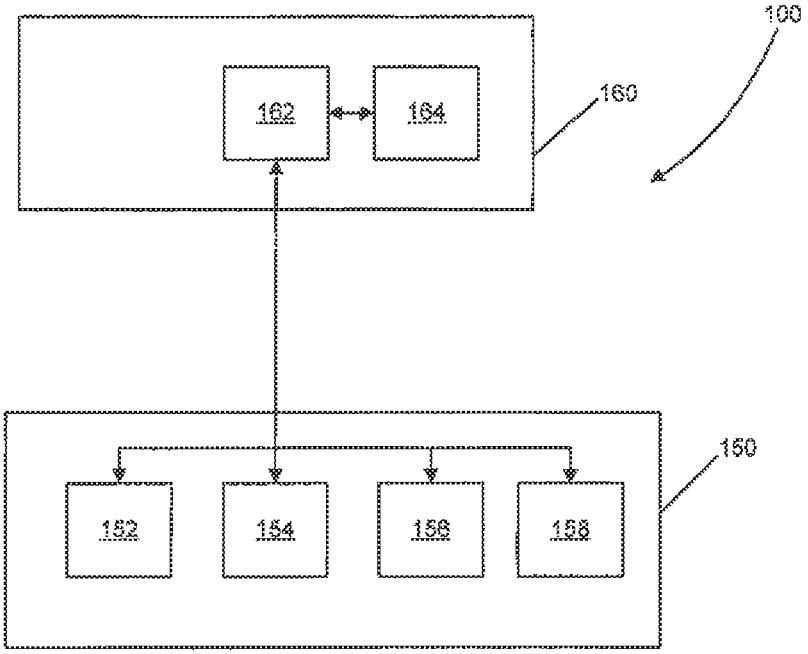
FIG. 1 is a block diagram of the core components of a gaming system.

Irrespective of the form, the gaming system 100 has several core components. At the broadest level, the core components are a player interface 150 and a game controller 160 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 152 to enable a player to input credits and receive payouts, one or more displays 154, a game play mechanism 156 including one or more input devices that enable a player to input game play instructions (e.g. to place a wager), and one or more speakers 158.

The game controller 160 is in data communication with the player interface and typically includes a processor 162 that processes the game play instructions in accordance with game play rules and outputs game play outcomes to the display. Typically, the game play rules are stored as program code in a memory 164 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
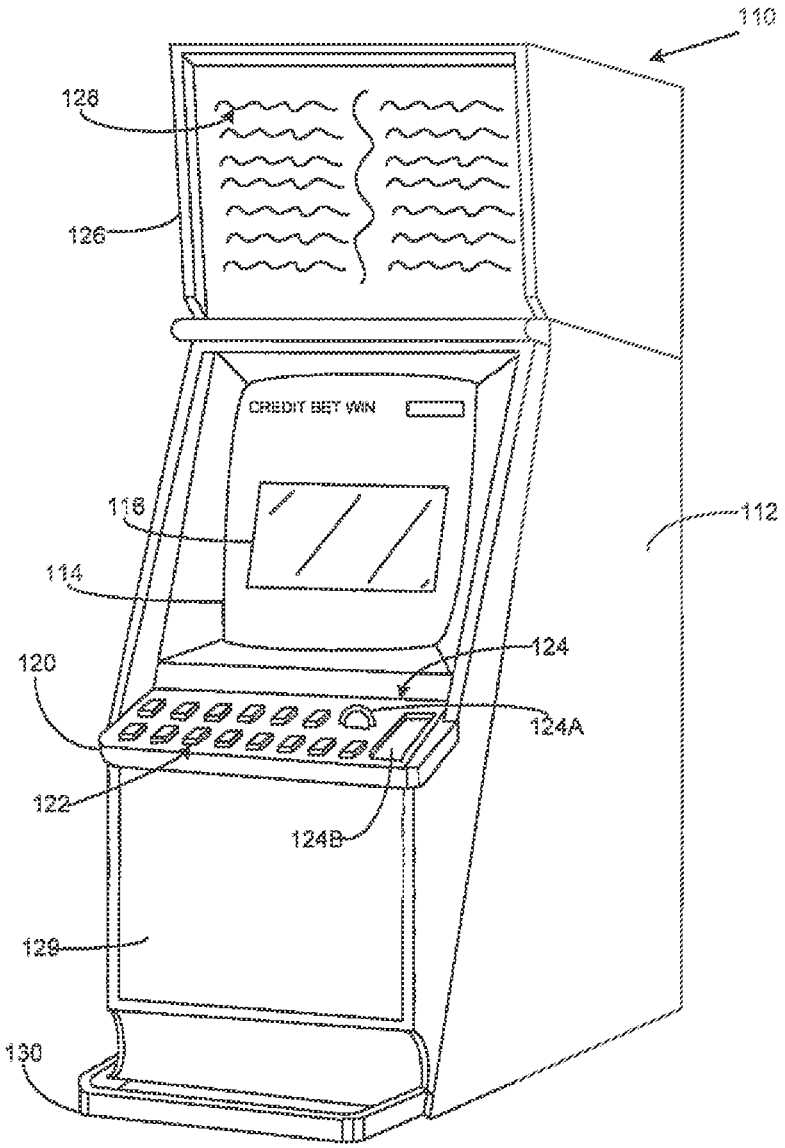
FIG. 2 is a perspective view of a stand alone gaming machine.

A gaming system in the form of a stand alone gaming machine 110 is illustrated in FIG. 2. The gaming machine 110 includes a console 112 having a display 114 on which are displayed representations of a game 116 that can be played by a player. A mid-trim 120 of the gaming machine 110 houses a bank of electromechanical buttons 122 for enabling a player to interact with the gaming machine, in particular during game play. The mid-trim 120 also houses a credit input mechanism 124 which in this example includes a coin input chute 124A and a bill collector 124B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 126 may carry artwork 128, including for example pay tables and details of bonus awards and other information or images relating to the game. Further artwork and/or information may be provided on a front panel 129 of the console 112. A coin tray 130 is mounted beneath the front panel 129 for dispensing cash payouts from the gaming machine 110.

The display 114 shown in FIG. 2 is in the form of a video display unit, particularly a cathode ray tube screen device. Alternatively, the display 114 may be a liquid crystal display, plasma screen, any other suitable video display unit, or the visible portion of an electromechanical device. The top box 126 may also include a display, for example a video display unit, which may be of the same type as the display 114, or of a different type.

Figure 3:
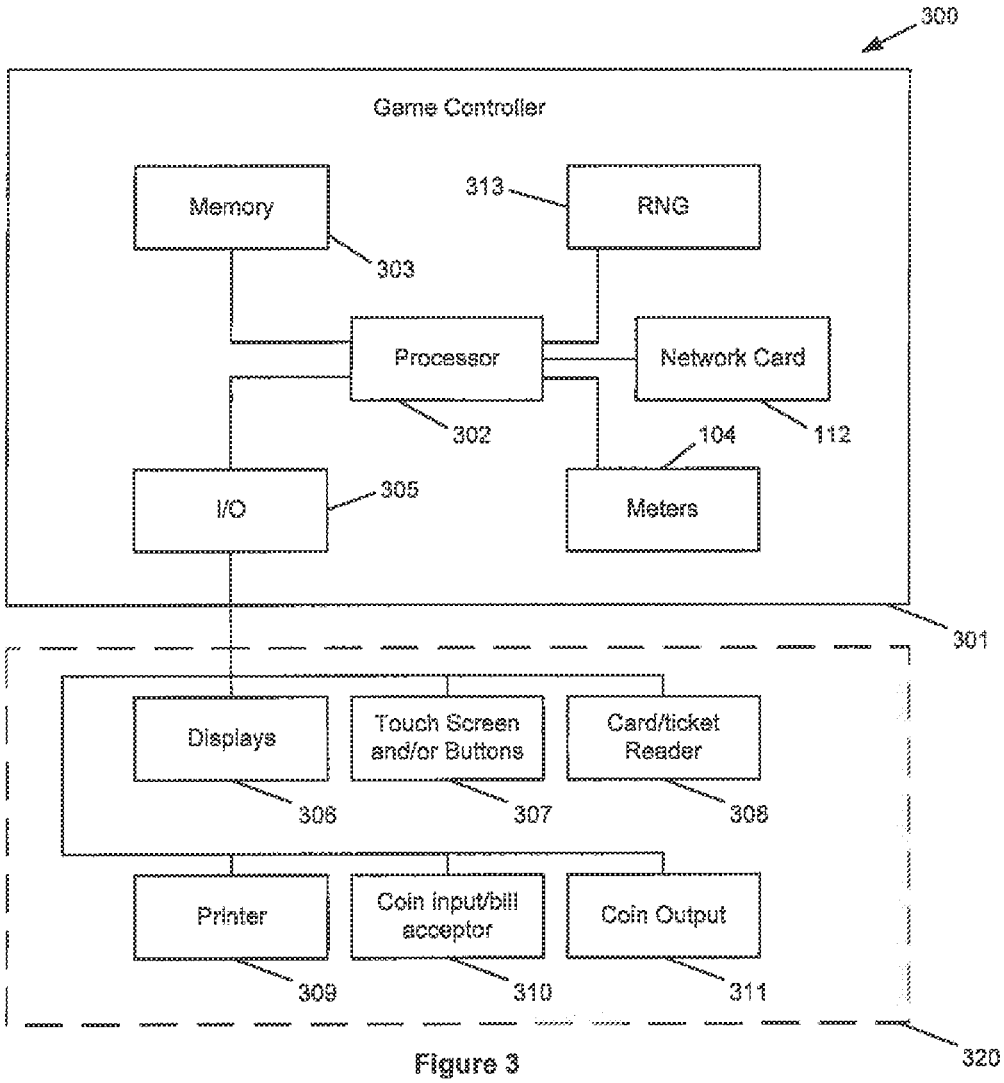
FIG. 3 is a block diagram of the functional components of a gaming machine.

FIG. 3 shows a block diagram of operative components of a typical gaming machine which may be the same as or different to the gaming machine of FIG. 2.

The gaming machine 300 includes a game controller 301 having a processor 302 mounted on a circuit board. Instructions and data to control operation of the processor 302 are stored in a memory 303, which is in data communication with the processor 302. Typically, the gaming machine 300 will include both volatile and non-volatile memory and more than one of each type of memory, with such memories being collectively represented by the memory 303.

The gaming machine has hardware meters 304 for purposes including ensuring regulatory compliance and monitoring player credit, an input/output (I/O) interface 305 for communicating with peripheral devices of the gaming machine 300. The input/output interface 305 and/or the peripheral devices may be, intelligent devices with their own memory for storing associated instructions and data for use with the input/output interface or the peripheral devices. A random number generator module 313 generates random numbers for use by the processor 302. Persons skilled in the art will appreciate that the reference to random numbers includes pseudo-random numbers.

In the example shown in FIG. 3, a player interface 320 includes peripheral devices that communicate with the game controller 301 including one or more displays 106, a touch screen and/or buttons 307 (which provide a game play mechanism), a card and/or ticket reader 308, a printer 309, a bill acceptor and/or coin input mechanism 310 and a coin output mechanism 311. Additional hardware may be included as part of the gaming machine 300, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 300 may include a communications interface, for example a network card 312. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
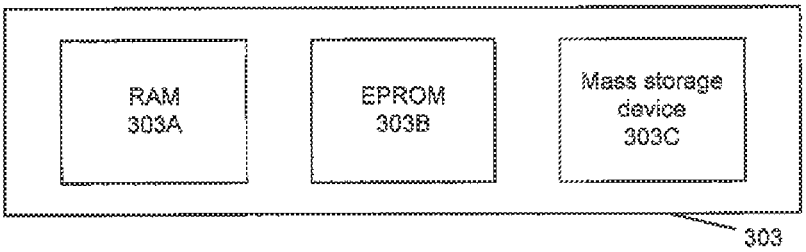
FIG. 4 is a schematic diagram of the functional components of a memory.

FIG. 4 shows a block diagram of the main components of an exemplary memory 303. The memory 303 includes RAM 303A, EPROM 3038 and a mass storage device 303C. The RAM 303A typically temporarily holds program files for execution by the processor 302 and related data. The EPROM 303B may be a boot ROM device and/or may contain some system or game related code. The mass storage device 303C is typically used to store game programs, the integrity of which may be verified and/or authenticated by the processor 302 using protected code from the EPROM 303B or elsewhere.

It is also possible for the operative components of the gaming machine 300 to be distributed, for example input/output devices 306, 307, 308, 309, 310, 311 to be provided remotely from the game controller 301.

Figure 5:
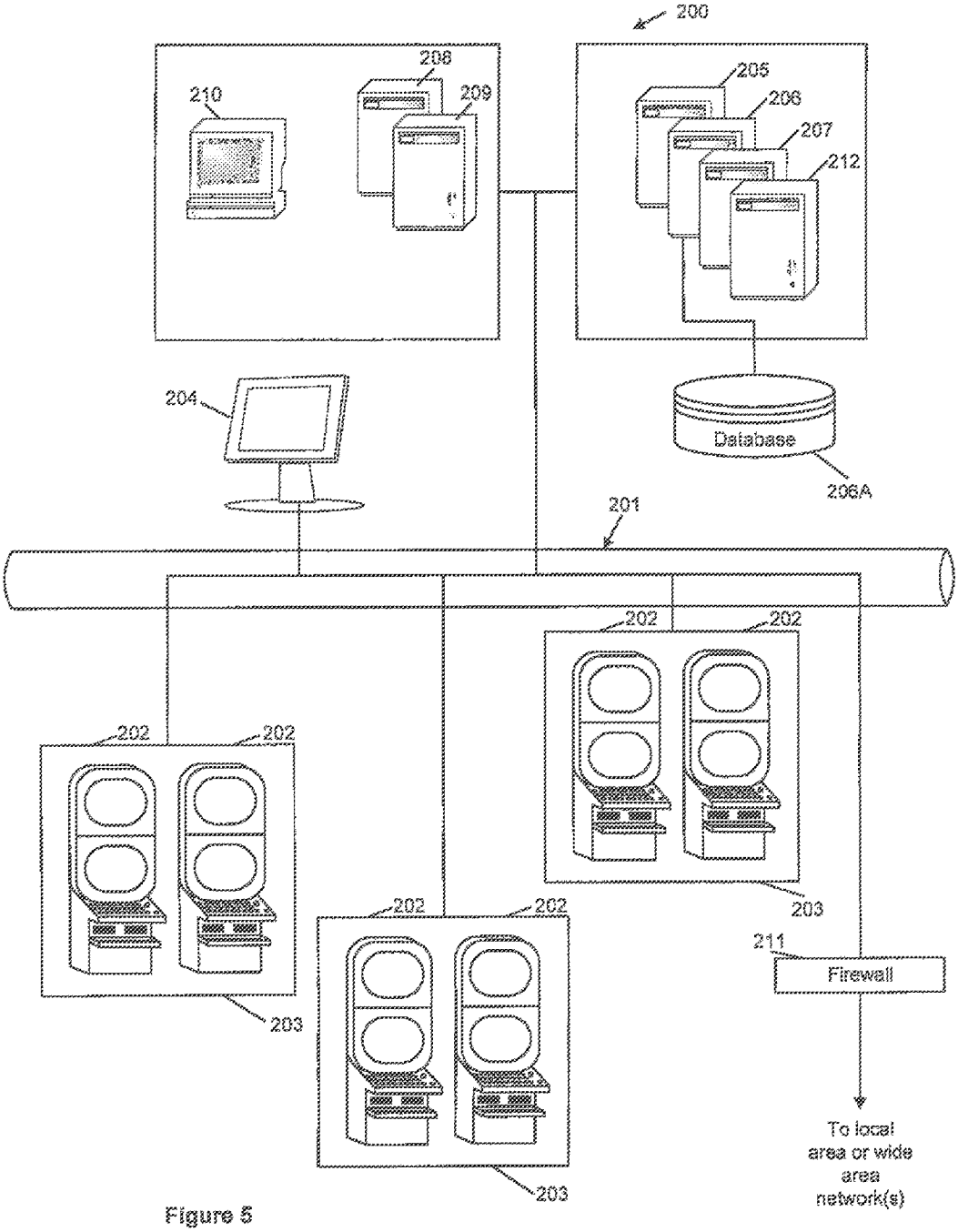
FIG. 5 is a schematic diagram of a network gaming system.

FIG. 5 shows a gaming system 200 in accordance with an alternative embodiment. The gaming system 200 includes a network 201, which for example may be an Ethernet network.

Gaming machines 202, shown arranged in three banks 203 of two gaming machine 202 in FIG. 5, are connected to the network 201. The gaming machines 202 provide a player operable interface and may be the same as the gaming machines 110,300 shown in FIGS. 11 and 12, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be s associated with one or more banks 203 of gaming machines.

The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine.

Alternatively, a separate random number generator server could be provided. Further, persons skilled in the art will appreciate that a plurality of game servers could be provided to run different games or a single game server may run a plurality of different games as required by the terminals.

Figure 6:
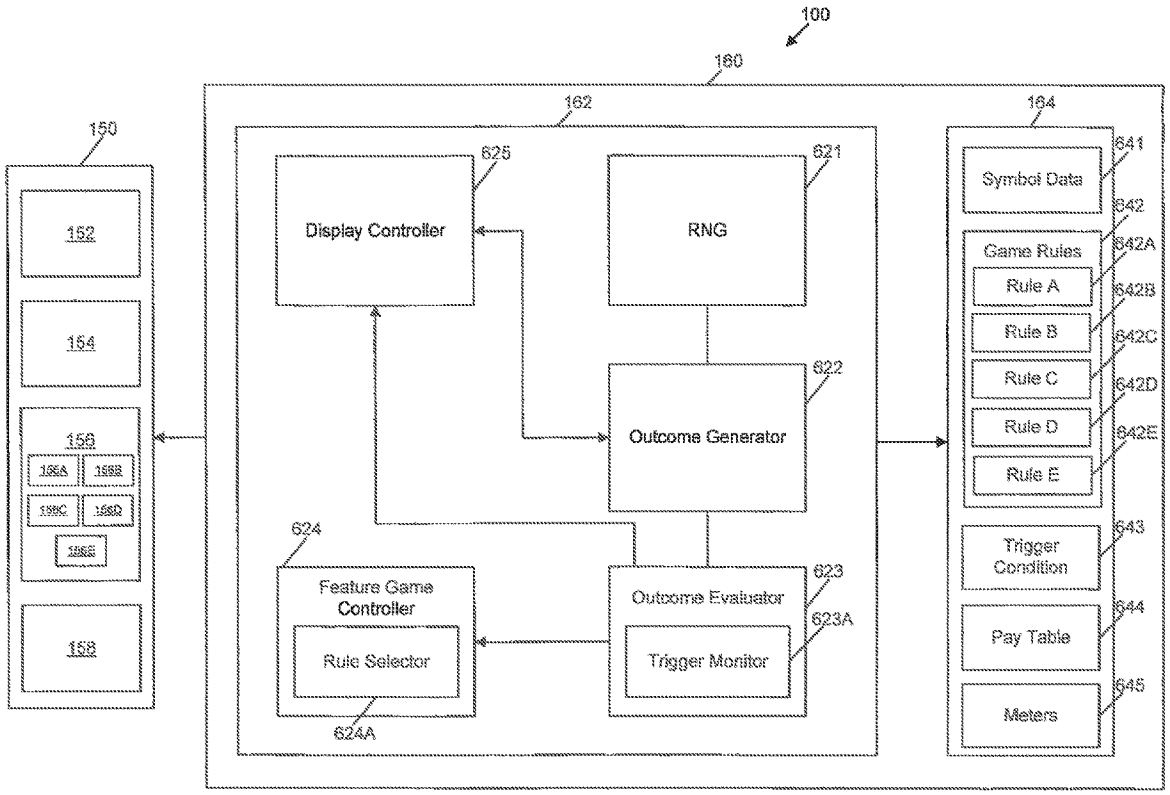
FIG. 6 is a further block diagram of a gaming system.

FIG. 6, shows an example of a gaming system 100, where an additional benefit may be provided to the player during the play of a feature game depending on the wager which the player places. In FIG. 6, the processor 162 of game controller 60 is shown implementing a number of modules based on program code stored in memory 164. Persons skilled in the art will appreciate that various of the modules could be implemented in some other way, for example by a dedicated circuit. Player interface 150, comprises a display 154, a speaker 158, a credit mechanism 152 and a game play mechanism 156. The player operates the game play mechanism 156 to specify one of five different possible wagers by pressing a button 156A, 156B, 156C, 156D, 156E associated with respective ones of Wager A, Wager B, Wager C, Wager D and Wager E as summarised in Table 1.

additional "free games" during a feature game. That is, in the embodiment, there is a base number of free games and these are added to if one of Wagers B-E is made.

In this respect, persons skilled in the art will appreciate that the base game is a part of the game which is carried out each time the player makes a wager and initiates a play of the game whereas a feature game is a part of the game which will only be carried out occasionally upon a trigger condition being met. That is, a feature game involves some additional element of game play which only occurs when a trigger condition is met. Here, the feature game is in the form of "free games" which in the art means that a series of games like the base game are carried out for the player before the player needs to place a further wager and initiate play of the gaming machine again. In the embodiment, the game is a spinning reel game, and the free games are conducted by spinning each reel again, and evaluating the displayed symbols when then reels stop to determine whether the player is entitled to an award. Persons skilled in the art, will appreciate that the concept of "free games" can include games where there is some modification to the game rules relative to the base game, for example, a multiplier is applied to awards, a symbol performs an additional function, the symbol set is changed etc. Persons skilled in the art, will also appreciate that other feature games can be employed including other games where a series of free game events are awarded such as re-spins (where some reels are held while others are re-spun); or "second screen" games where game play is totally different to the base game, for example where the player makes selections in a "pick a box type" game. The additional benefit provided to the player can be designed in accordance with the game, for example, in a pick a box game the additional benefit may be an entitlement to additional selections.

In the example of Table 1, each of Wagers A-E are associated with a player playing twenty lines of a twenty line game and the player is only allowed to place a wager including an additional wager portion if playing all twenty lines. Persons skilled in the art will appreciate that in other embodiments there may be other wagers associated with different numbers of win lines. Such win lines are formed by a combination of symbol display positions, one from each reel, the symbol display positions being located relative to one another such that they form a line.

Depending on the implementation, the player's entitlement to winning outcomes may not strictly limited to the lines they have selected, for example, "scatter" pays are awarded independently of a players selection of pay lines and are an inherent part of the win entitlement.

TABLE 1

| Wager | Total Bet | Standard/Ante | Ante Proportion | Ante bet game rule |
|---|---|---|---|---|
| Wager A | 50 credits | 50 credits + 0 credit ante | 0.000 | None (Rule A) |
| Wager B | 125 credits | 100 credits + 25 credit ante | 0.200 | Extra 5 free games during the feature (Rule B) |
| Wager C | 200 credits | 150 credits + 50 credit ante | 0.250 | Extra 7 free games during the feature (Rule C) |
| Wager D | 350 credits | 250 credits + 100 credit ante | 0.286 | Extra 10 free games during the feature (Rule D) |
| Wager E | 500 credits | 350 credits + 150 credit ante | 0.300 | Extra 15 free games during the feature (Rule E) |

Table 1, shows five wagers which the player may place when playing twenty lines in a twenty play line game. Wager A has only a "standard" or base portion whereas Wagers B-E each have base portions and an "ante" or additional portions. It will be apparent that the relative proportion of the additional wager portion increases from Wager B-E as does the additional benefit in the form of a designated number of The outcome generator 622 operates in response to the player's operation of game play mechanism 56 to place the wager and initiate a play of the game and generates a game outcome which is then be evaluated by outcome evaluator 623. The first part of forming the game outcome is for the outcome generator to select symbols from a set of symbols specified by symbol data 641 using random number generator 621. The selected symbols are advised to the display controller 626 which causes them to be displayed on display 154 at a set of display positions.

In the embodiment of a spinning-reel game, the symbol data 641 can specify a sequence of symbols for each reel such that the outcome generator can select all of the symbols by selecting a stopping position in the sequence. In one example, three symbols of each of five reels may be displayed such that symbols are displayed at fifteen display positions on display 154. It is known to use a probability table stored in memory 164 to vary the odds of a particular stop position being selected. Other techniques can be used to control the odds of particular outcomes occurring to thereby control the return to player of the game.

The outcome evaluator 623 evaluates the displayed symbols by comparing the symbols on the win lines to symbol combinations stored in the pay table 643 to determine whether the player has one or more winning outcomes which entitles the player to an award of credits. Any award of credits is placed on a win meter shown on the display and meter data 645 updated accordingly. As part of the evaluation, outcome evaluator 623 also determines from the outcome whether a designated event has occurred and as such whether the additional benefit corresponding to the additional wager should be provided. In this embodiment, the evaluation is by a trigger monitor 623A determining whether the symbols selected by outcome generator 622 include a trigger condition 643, e.g. three scattered designated symbols. In other embodiments, the designated event may be the occurrence of a specific symbol in the game, be caused by another connected system, based on turnover, based on a random evaluation etc.

Once the trigger monitor determines that the trigger condition is met, the feature controller 624 is activated to carry out the free games. The feature controller 624 has a rule selector 624A which determines which of Rules A to E 642A-642E are to be employed from game rule data 642 based on which of Wagers A to E has been placed. The feature controller then conducts the relevant number of free games by controlling the outcome generator 622 to generate a series of outcomes and the outcome evaluator 623 to evaluate each of these outcomes.

It will be appreciated that in the above embodiment, there is a common designated event which acts as the trigger condition, in other embodiments there may be different designated events depending on the selected wager. In such an embodiment, the rule selector may not be part of the feature controller 624, for example, it could be part of the trigger monitor. In such an embodiment, the rule selection may occur at a different part of the game, for example when the wager is made. Indeed, the rule selection may be made at any suitable time in any embodiment to ensure the correct rule is implemented.

It will be appreciated that the invention also provides a method and that at least part of the method will be implemented digitally by a processor. Persons skilled in the art will also appreciate that the method could be embodied in program code. The program code could be supplied. in a number of ways, for example on a tangible computer readable storage medium, such as a disc or a memory (for example, that could replace part of memory 103) or as a data signal (for example, by transmitting it from a server). Persons skilled in the art, will appreciate that program code provides a series of instructions executable by the processor.

It will be understood to persons skilled in the art of the invention that many modifications may be made without departing from the spirit and scope of the invention, in particular it will be apparent that certain features of embodiments of the invention can be employed to form further embodiments. For example, the above embodiment describes a player selecting win lines, in other embodiments, the player select a number of reels to play and an amount to wager per reel. Such games are marketed under the trade name "Reel Power" by Aristocrat Leisure Industries Pty Ltd. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the centre row are used for non-selected reels. As a result, the total number of ways to win is determined by multiplying the number of active display positions of each reels, the active display positions being all display positions of each selected reel and the designated display position of the non-selected reels. As a result for five reels and fifteen display positions there are 243 ways to win.

Further some embodiments allow free games to be re-triggered if the trigger condition is met during the free game and such re-triggers could be incorporated into the above embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprise's" or "comprising" is used in an inclusive sense, i.e. to specify the presence of the stated features but not to preclude the presence or addition of further features in various embodiments of the invention.

The invention claimed is:

1. A gaming system for playing a game, the gaming system comprising:

a display having a plurality of display positions;

a player operable game play mechanism having a plurality of buttons, each of the plurality of buttons corresponding to one of a plurality of predefined wagers, each of the plurality of buttons being operable by a player to provide a selection of the respective button's corresponding predefined wager on a play of the game and to initiate the play of the game, the plurality of predefined wagers comprising a predefined first wager consisting of a base wager, and second and third wagers each consisting of a base wager portion and an additional wager portion, the additional wager portion to the base wager portion being predefined for each of the second wager and the third wager, and the third wager having a higher additional wager portion than the second wager;

a memory configured to store a plurality of game play rules, a first of the game play rules corresponding to the first wager, a second of the game play rules corresponding to the second wager and a third of the game player rules corresponding to the third wager; and a game controller configured to be responsive to one of the buttons providing a selection of one predefined wager, said game controller configured to select from the memory one of the game play rules corresponding to the selected one predefined wager, to implement the play of the game with the selected one of the game play rules, to generate at least one game outcome based on the selected one of the game play rules, and to evaluate the game outcome to determine whether the player is entitled to an award;

wherein the display displays the at least one game outcome including a plurality of symbols at a plurality of the display positions, wherein said game controller is further configured to control the game in accordance with the game play rules to generate the at least one game outcome in the play of the game based at least on whether the wager in respect of the play of the game is the first wager, the second wager or the third wager, wherein the game controller is further configured to provide:

upon said second wager being made, a first additional benefit to the player, and upon said third wager being made, a second additional benefit to the player, the second additional benefit being a greater benefit than the first additional benefit, such that providing a wager having a higher additional wager portion entitles the player to a higher additional benefit, wherein said game controller includes a feature game controller configured to respond to a trigger event, said trigger event being associated with both the second and third wagers, wherein the trigger event triggers the game controller to generate at least one additional game outcome, and wherein the game controller is configured to generate a plurality of additional game outcomes in response to the trigger event and to provide a greater benefit for the third wager by generating more additional game outcomes when the trigger event occurs in respect of the third wager than in respect of the second wager.

2. A gaming system as claimed in claim 1, wherein the game controller is configured to generate a single game outcome in a game in which the trigger event does not occur.

3. A gaming system as claimed in claim 1, wherein the game controller is configured to generate a plurality of additional game outcomes upon the trigger event occurring in respect of the first wager; and wherein the first and second additional benefits comprise different numbers of additional game outcomes.

4. A gaming system as claimed in claim 1, wherein the game is a spinning reel game; and wherein the game controller is configured to generate a game outcome by controlling the reels to be displayed as spinning on the display and to determine which symbols of a plurality of reels will be displayed to a player in the plurality of display positions on the display when the reels stop, and to evaluate the displayed symbols to determine whether the player is entitled to an award.

5. A gaming system as claimed in claim 4, wherein the game controller is configured to generate each additional game outcome via re-spinning each of the reels to determine a further set of symbols of the plurality of reels to be displayed and evaluating the further set of symbols to determine whether the player is entitled to an award.

6. A gaming system as claimed in claim 1, wherein the player places the wager with a single one of the buttons.

7. A gaming system as claimed in claim 1, wherein the game play mechanism is a touch screen configured to display a plurality of virtual buttons.

8. A gaming system as claimed in claim 1, wherein the buttons are electromechanical buttons.

9. A gaming system for playing a game, the gaming system comprising:

a display having a plurality of display positions;

a player operable game play mechanism having a plurality of buttons, each of the plurality of buttons corresponding to one of a plurality of predefined wagers, each of the plurality of buttons being operable by a player to provide a selection of the respective button's corresponding predefined wager on a play of the game and to initiate the play of the game, the plurality of predefined wagers comprising a predefined first wager consisting of a base wager, and second and third wagers each consisting of a base wager portion and an additional wager portion, the additional wager portion to the base wager portion being predefined for each of the second wager and the third wager, and the third wager having a higher additional wager portion than the second wager;

a memory configured to store a plurality of game play rules, a first of the game play rules corresponding to the first wager, a second of the game play rules corresponding to the second wager and a third of the game player rules corresponding to the third wager; and a game controller configured to be responsive to one of the buttons providing a selection of one predefined wager, said game controller configured to select from the memory one of the game play rules corresponding to the selected one predefined wager, to implement the play of the game with the selected one of the game play rules, to generate at least one game outcome based on the selected one of the game play rules, and to evaluate the game outcome to determine whether the player is entitled to an award;

wherein the display displays the at least one game outcome including a plurality of symbols at a plurality of the display positions, wherein said game controller is further configured to control the game in accordance with the game play rules to generate the at least one game outcome in the play of the game based at least on whether the wager in respect of the play of the game is the first wager, the second wager or the third wager, wherein the game controller is further configured to provide:

upon said second wager being made, a first additional benefit to the player, and upon said third wager being made, a second additional benefit to the player, the second additional benefit being a greater benefit than the first additional benefit, such that providing a wager having a higher additional wager portion entitles the player to a higher additional benefit, wherein said game controller includes a feature game controller configured to respond to a trigger event, said trigger event being associated with both the second and third wagers, wherein the trigger event triggers the game controller to generate at least one additional game outcome, wherein the game is a spinning reel game; and wherein the game controller is configured to generate a game outcome by controlling the reels to be displayed as spinning on the display and to determine which symbols of a plurality of reels will be displayed to a player in the plurality of display positions on the display when the reels stop, and to evaluate the displayed symbols to determine whether the player is entitled to an award, and wherein the game controller is configured to generate each additional game outcome via re-spinning a subset of the reels to determine a further set of symbols to be displayed and evaluating the further set of symbols to determine whether the player is entitled to an award.

10. A game controller for a gaming system having 1) device a player operable game play mechanism having a plurality of buttons, each of the plurality of buttons corresponding to one of a plurality of predefined wagers, each of the plurality of buttons being operable by a player to provide a selection of the respective button's corresponding predefined wager on a play of the game and to initiate the play of the game, the plurality of predefined wagers comprising a predefined first wager consisting of a base wager, and second and third wagers each consisting of a base wager portion and an additional wager portion, the additional wager portion to the base wager portion being predefined for each of the second wager and the third wager, and the third wager having a higher additional wager portion than the second wager, 2) a memory configured to store a plurality of game play rules, a first of the game play rules corresponding to the first wager, a second of the game play rules corresponding to the second wager and a third of the game player rules corresponding to the third wager, and, in accord with one of the buttons providing a selection of one predefined wager, the game controller is configured to select from the memory one of the game play rules corresponding to the selected one predefined wager, and to implement the play of the game with the selected one of the game play rules, to generate at least one game outcome based on the selected one of the game play rules, and to evaluate the game outcome to determine whether a player is entitled to an award, to control display to display the at least one game outcome including a plurality of symbols at a plurality of the display positions and wherein the game controller being configured to provide:

upon said second wager being made, a first additional benefit to the player, and upon said third wager being made, a second additional benefit to the player, the second additional benefit being a greater benefit than the first additional benefit, such that providing a wager option having a higher additional wager portion entitles the player to a higher additional benefit, wherein said game controller includes a feature game controller configured to respond to a trigger event, said trigger event being associated with both the second and third wagers, wherein the trigger event triggers the game controller to generate at least one additional game outcome, and wherein the game controller is configured to generate a plurality of additional game outcomes in response to the trigger event and to provide a greater benefit for the third wager by generating more additional game outcomes when the trigger event occurs in respect of the third wager than in respect of the second wager.

11. A game controller as claimed in claim 10, wherein the game controller is configured to generate a single game outcome in a game in which the trigger event does not occur.

12. A game controller as claimed in claim 10, wherein the game controller is configured to generate a plurality of additional game outcomes upon the trigger event occurring in respect of the first wager; and wherein the first and second additional benefits comprise different numbers of additional game outcomes.

13. A game controller as claimed in claim 10, wherein the game is a spinning reel game; and wherein the game controller is configured to generate a game outcome by controlling the reels to be displayed as spinning on the display and to determine which symbols of a plurality of reels will be displayed to a player in the plurality of display positions on the display when the reels stop, and to evaluate the displayed symbols to determine whether the player is entitled to an award.

14. A game controller as claimed in claim 13, wherein the game controller is configured to generate each additional game outcome via re-spinning each of the reels to determine a further set of symbols of the plurality of reels to be displayed and evaluating the further set of symbols to determine whether the player is entitled to an award.

15. A game controller for a gaming system having 1) device a player operable game play mechanism having a plurality of buttons, each of the plurality of buttons corresponding to one of a plurality of predefined wagers, each of the plurality of buttons being operable by a player to provide a selection of the respective button's corresponding predefined wager on a play of the game and to initiate the play of the game, the plurality of predefined wagers comprising a predefined first wager consisting of a base wager, and second and third wagers each consisting of a base wager portion and an additional wager portion, the additional wager portion to the base wager portion being predefined for each of the second wager and the third wager, and the third wager having a higher additional wager portion than the second wager, 2) a memory configured to store a plurality of game play rules, a first of the game play rules corresponding to the first wager, a second of the game play rules corresponding to the second wager and a third of the game player rules corresponding to the third wager, and, in accord with one of the buttons providing a selection of one predefined wager, the game controller is configured to select from the memory one of the game play rules corresponding to the selected one predefined wager, and to implement the play of the game with the selected one of the game play rules, to generate at least one game outcome based on the selected one of the game play rules, and to evaluate the game outcome to determine whether a player is entitled to an award, to control display to display the at least one game outcome including a plurality of symbols at a plurality of the display positions and wherein the game controller being configured to provide:

upon said second wager being made, a first additional benefit to the player, and upon said third wager being made, a second additional benefit to the player, the second additional benefit being a greater benefit than the first additional benefit, such that providing a wager option having a higher additional wager portion entitles the player to a higher additional benefit, wherein said game controller includes a feature game controller configured to respond to a trigger event, said trigger event being associated with both the second and third wagers, wherein the trigger event triggers the game controller to generate at least one additional game outcome, wherein the game is a spinning reel game; and wherein the game controller is configured to generate a game outcome by controlling the reels to be displayed as spinning on the display and to determine which symbols of a plurality of reels will be displayed to a player in the plurality of display positions on the display when the reels stop, and to evaluate the displayed symbols to determine whether the player is entitled to an award, and wherein the game controller is configured to generate each additional game outcome via re-spinning a subset of the reels to determine a further set of symbols to be displayed and evaluating the further set of symbols to determine whether the player is entitled to an award.

* * * * *